United States Patent [19]

Weavell

[11] 4,027,563

[45] June 7, 1977

[54] CONTROLLED TRANSVERSELY MOVABLE GUIDE MEANS FOR LUMBER

[75] Inventor: Jack Weavell, Coquitlam, Canada

[73] Assignee: CAE Machinery Ltd., Vancouver, Canada

[22] Filed: June 1, 1976

[21] Appl. No.: 691,308

[52] U.S. Cl. ..... 83/106; 83/150; 83/156; 83/160; 83/420; 83/421; 83/449; 83/732; 73/809; 144/253 H

[51] Int. Cl.[2] ..... B27B 27/02; B27B 27/10

[58] Field of Search ..... 83/105, 106, 150, 732, 83/420, 421, 444, 449, 156, 160, 809; 144/253 H

[56] References Cited

UNITED STATES PATENTS

| | | | |
|---|---|---|---|
| 2,714,906 | 8/1955 | Peterson | 83/421 X |
| 2,761,473 | 9/1956 | Denton | 83/732 X |
| 3,139,125 | 6/1964 | Pearson | 83/106 |
| 3,207,017 | 9/1965 | McCain | 83/105 X |
| 3,236,272 | 2/1966 | Lawson | 83/421 X |

*Primary Examiner*—Frank T. Yost
*Attorney, Agent, or Firm*—Fetherstonhaugh and Company

[57] ABSTRACT

Precision guide means for accurately directing lumber to and/or receiving cut lengths from saws. The guide means is mounted for selective movement by setworks back and forth across a path along which the lumber moves. A closed hydraulic system includes piston-cylinder units with a unit near each of opposite ends of the guide means. One end of each cylinder unit is fixed against movement and the opposite end thereof is connected to the adjacent end of the guide means, and pipe means interconnects these cylinder units so that when the guide means is moved, hydraulic fluid is transferred from an end of one of the units to an opposite end of another unit to ensure that both ends of the guide means move exactly the same distance. The guide means can be a linebar and a tailbar interconnected by the hydraulic system so that they are moved in unison exactly the same distance by the setworks. The guide means can be or include a relatively long splitter.

7 Claims, 11 Drawing Figures

Fig. 7.
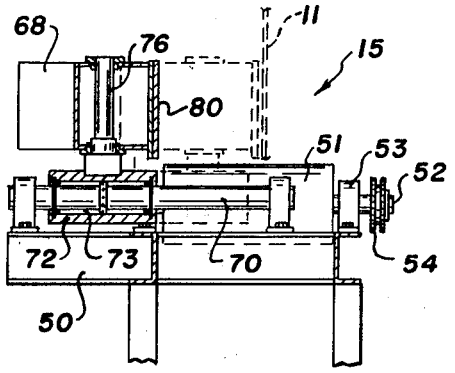
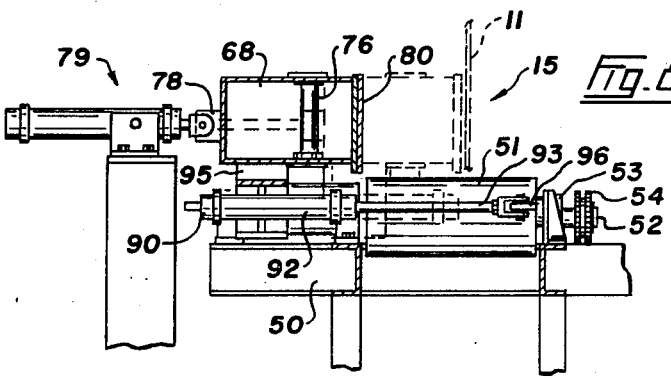
Fig. 8.
Fig. 9.
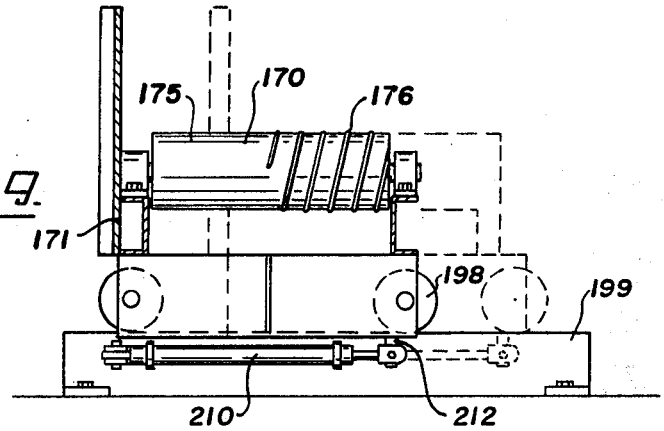

CONTROLLED TRANSVERSELY MOVABLE GUIDE MEANS FOR LUMBER

FIELD OF INVENTION

This invention relates to a transversely movable guide means for wood before and after sawing. This sawing operation is known as the secondary breakdown or resawing of cants into green lumber of different selected widths.

This invention is primarily for interconnecting a linebar and a tailbar, one of which is moved by setworks, so that they move in unison exactly the same distance and so that both ends of the linebar and of the tailbar move exactly the same distance at the same time. However, the same basic system can also be used in association with a relatively long splitter so as to ensure both ends of the splitter moving exactly the same distance each time the splitter is moved.

DESCRIPTION OF PRIOR ART

Linebars are commonly used in resawing systems. These are separate units for guiding lengths of wood, which herein are cants for the sake of convenience, to the resaw. The linebar is next to the saw to direct the cants to the latter and usually is shifted transversely of the path along which the cants are moved so as to determine the width of the wood cut by the saw. The tailbar is located up-stream from the linebar and directs the cants to the latter. As the linebar is moved transversely of the path by setworks, the tailbar must move with it. These units are kept separate to provide operator access and to protect the linebar against movement when cants are being fed against the tailbar. Prior to the present invention, a linebar and tailbar were interconnected for simultaneous movement by mechanical linkages. These linkages took the form of either a long shaft with pinions operating racks to control the movement, or a shaft working parallelogram-type links. With the mechanical linkages, the linebar was frequently subjected to unequal loading, such as when large cants being fed to the apparatus hit the tailbar or one end of the linebar while the saw is sawing the cant ahead. Any deflection of the linebar causes the thickness of wood being cut to vary. With the mechanical linkages, it has been impossible completely to isolate the linebar, which actually directs wood to the saw, against shocks encountered by the tailbar, and it has not been possible to keep the linebar in its proper straight line position relative to the saw when its upstream end is struck by a cant. The mechanical linkages often transfer shocks from the tailbar to the linebar causing unwanted movement of the latter while the cant is being guided past the saw. The mechanical linkages, due to the necessary play in the connections of the links, also would permit movement of one end of the line bar relative to the other.

A further problem of the mechanically linked system concerned the pressure exerted by the side press rolls. The side press rolls push against the lumber and hold it against the linebar. When the end of a piece of lumber passed the press roll, pressure between the lumber and the linebar caused by the press roll was suddenly relieved, causing the linebar to spring back. This in turn caused tail end snipe, where the last few inches of a piece of sawn lumber is thinner than the remainder.

Splitters receive the sawn lumber from the saw, and many saws are selectively moved transversely of the path of travel by setworks, in which case the splitter is connected to the saw to move with it. As the moving forces are connected to one end of the splitter, and the latter is relatively long, it has been difficult to shift the down-stream end of the splitter exactly the same distance as the upstream end thereof.

SUMMARY OF INVENTION

The present invention greatly reduces or practically eliminates the problem of transferring unwanted movement from the tailbar to the linebar or of tailend snipe by substituting for the previously-used mechanical linkages a hydraulic system that ensures the tailbar always moving exactly the same distance as the linebar but without transferring any unwanted movement from the tailbar to the linebar, and ensures each end of each of these units moving exactly the same distance as the opposite end of said unit. The only physical connection between the linebar and the tailbar are light hydraulic pipes or hoses so that no shocks can be transferred from the tailbar to the linebar. This hydraulic system also interconnects the linebar to the tailbar and the opposite ends of each of these units so that there is a rigid hydraulic linkage between them and therefore one cannot move transversely of the path relative to the other end. Furthermore, the opposite end of these units move exactly the same distance as each other so that they maintain their proper alignment with the saw and the path of travel regardless of the fact that they are mounted for movement transversely of the path. The linebar and the tailbar actually constitute relatively long means for guiding the lengths of wood to the saw.

The hydraulic system employed with the splitter ensures that the opposite end of the splitter from the saw moves a similar distance when the saw to which the splitter in connected is moved by the setworks.

As stated above, the guide means involved with this invention is the linebar-tailbar combination upstream of the saw and/or a splitter downstream of the saw. However, the proper guiding of the linebar and tailbar, and the insulation and rigidity of these units from each other is the most important aspect of this invention.

In general terms, the guiding apparatus in accordance with the present invention comprises support means for supporting lengths of wood in a path of travel in which a saw is located, means for moving the wood lengths along the path to be cut longitudinally by the saw, relatively long guide means extending along and parallel with the path and mounted for movement transversely of said path and being selectively movable back and forth across the path by setworks connected thereto, a closed hydraulic system comprising a plurality of piston-cylinder units with a unit near each of opposite ends of the guide means, one end of each cylinder unit being fixed against movement and the opposite end of said each cylinder unit being connected to the adjacent end of the guide means, and pipe means so interconnecting said cylinder units that when the guide means is moved hydraulic fluid is transferred from an end of one of said units to an opposite end of another of said units to ensure the ends of the guide means moving in unison exactly the same distance.

More specifically, the guide means of this invention comprises supporting means for supporting lengths of wood in a path of travel in which a saw is located, means for moving the wood lengths along the path to be cut longitudinally by the saw, a linebar extending along the path near and to the saw and mounted for movement transversely of said path, a tailbar extending along the path and aligned with the linebar at the end thereof remote from the saw and mounted for movement transversely of the path, said linebar being selectively movable transversely of the path by setworks connected thereto, a closed hydraulic system comprising a plurality of piston-cylinder units with a unit near each of the opposite ends of both the linebar and tailbar, one end of each cylinder unit being fixed against movement and the opposite end of said each cylinder unit being connected to the adjacent end of the linebar or the tailbar, and pipe means so interconnecting said cylinder units that when the linebar is moved, hydraulic fluid is transferred from one end of each unit to an opposite end of another unit to ensure the linebar and the tailbar and the respective ends of the linebar and the tailbar moving in unison exactly the same distance.

Alternatively, the present guiding means comprises supporting means for supporting lengths of wood in a path of travel in which a saw is located, said saw being mounted for movement back and forth transversely of the path selectively by setworks connected thereto, guide means along the path for guiding the wood lengths to the saw, means for moving the wood lengths along the path to be cut longitudinally by the saw, guide means comprising a relatively long splitter extending away from the saw in said path to receive wood lengths cut by the saw, said splitter being mounted to move transversely of the path, means to connect an end of the splitter to the saw to cause the splitter to move therewith, a closed hydraulic system comprising a plurality of pistoncylinder units with a unit near each of opposite ends of the splitter, one end of each cylinder unit being fixed against movement and the opposite end of said each cylinder unit being connected to the adjacent end of the splitter, and pipe means so interconnecting said cylinder units that when the splitter is moved, hydraulic fluid is transferred from an end of one of said units to an opposite end of another of said units to ensure both ends of the splitter moving in unison exactly the same distance.

BRIEF DESCRIPTION OF DRAWINGS

Examples of this invention are illustrated in the accompanying drawings, in which FIG. 7 is a cross section taken on the line 7—7 of FIG. 5, FIG. 8 is a cross section taken on the line 8—8 of FIG. 5, FIG. 9 is an enlarged cross section taken on the line 9—9 of FIG. 4.

DESCRIPTION OF PREFERRED EMBODIMENT

Figure 1:
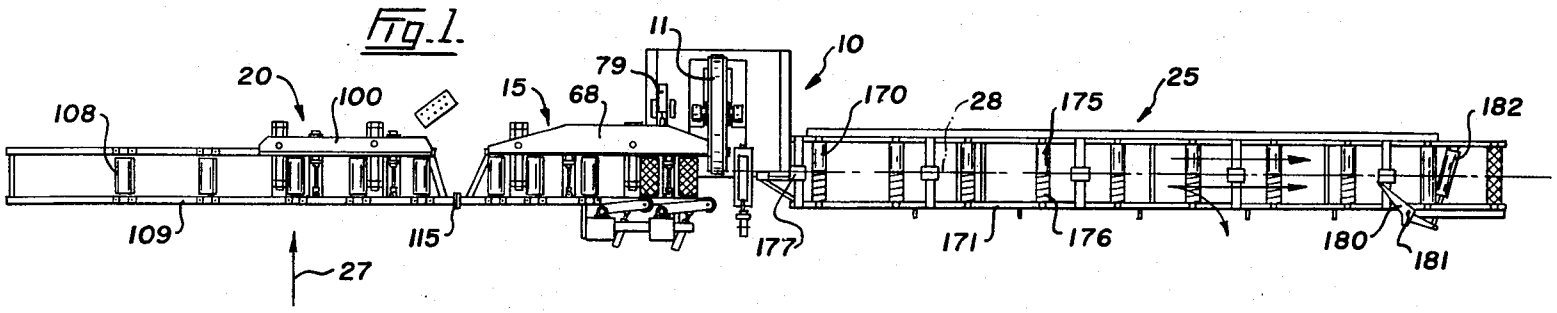
FIG. 1 is a diagrammatic plan view of sawing apparatus including movable linebar-tailbar combination and a stationary saw and splitter.
Figure 2:
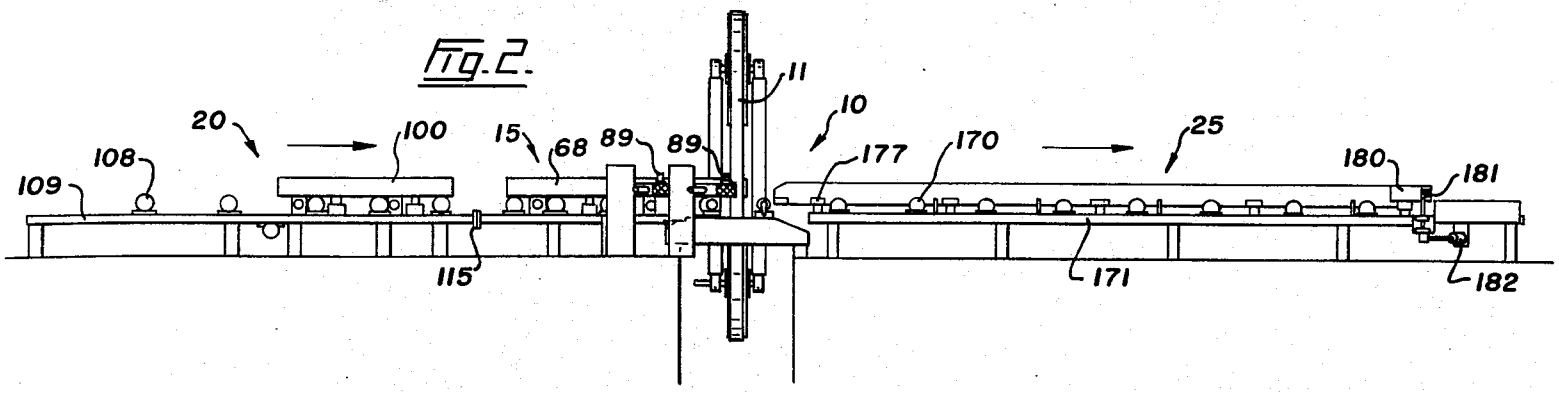
FIG. 2 is a side elevation of the apparatus of FIG. 1.

Referring to FIGS. 1 and 2 of the drawings, 10 is resaw apparatus including a saw 11 which, in this example, is a band saw, a linebar unit 15 having a movable linebar, a tailbar unit 20 having a movable tailbar, and a fixed splitter unit 25. The linebar unit 15 and tailbar unit 20 are located upstream from the saw and are aligned with each other and parallel with the splitter unit 25 which is downstream of the saw. The units 15, 20 and 25 constitute a lumber path along which lengths of wood, such as cants, are moved to be cut by saw 11, the cutting edge of which is located in this path.

Other systems, not shown, but equally applicable for this invention are twin resaws with either none, one or both saws movable and quad resaws with either fixed or movable saws.

When apparatus 10 is in operation, the cants to be cut are directed sideways into tailbar unit 20, as indicated by arrow 27. The cant is directed by unit 20 into the linebar unit 15 which directs the cant to saw 11. The linebar-tailbar combination of these units is shifted laterally relative to the path of travel in order to determine the width of the wood cut by the saw. The sawn wood is directed between either side of splitter 25 which separates the dimensioned piece from the other piece. This splitter has a longitudinal center line 28 which is aligned with the cutting path of the saw.

Figure 3:
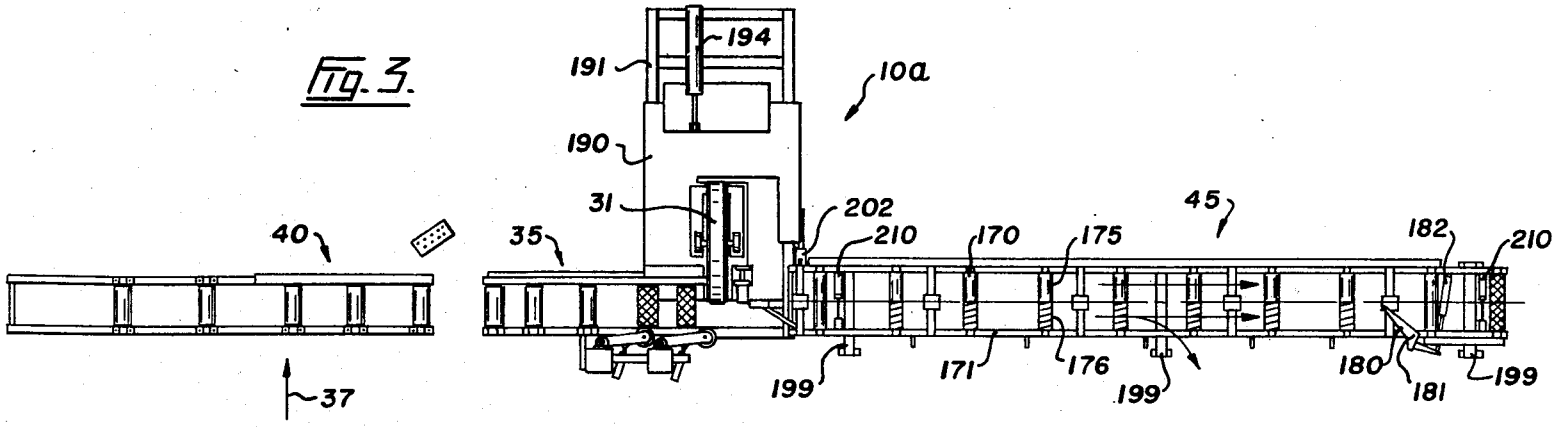
FIG. 3 is a diagrammatic plan view of sawing apparatus including a stationary linebar and tailbar, a movable saw and a movable splitter.
Figure 4:
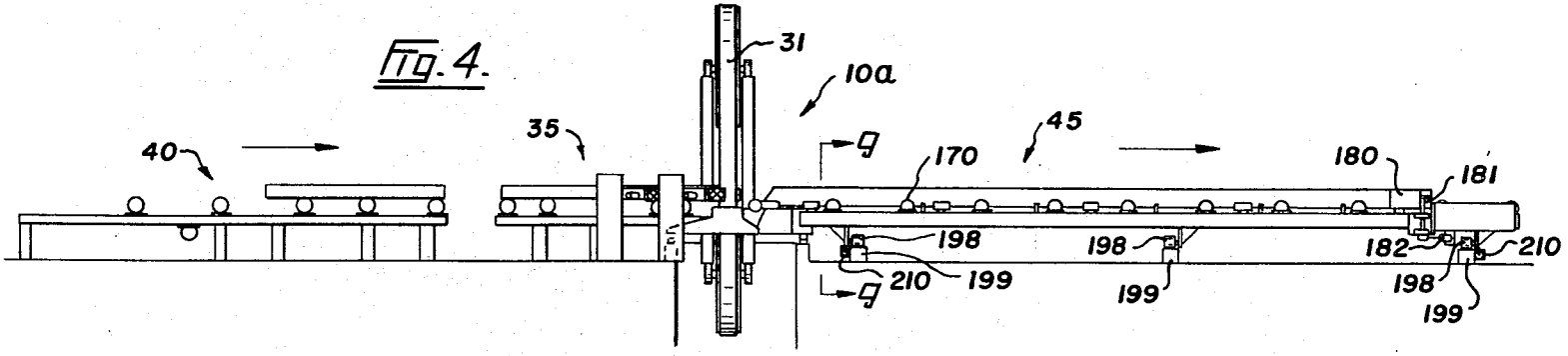
FIG. 4 is a side elevation of the apparatus of FIG. 3.

FIGS. 3 and 4 illustrate resaw apparatus 10*a* which includes a saw 31 which is mounted for movement transversely of the path of travel of the wood, a linebar unit 35 with a stationary linebar, a tailbar unit 40 with a stationary tailbar, and a splitter 45 mounted for movement transversely of the path.

When the apparatus 10*a* is in operation, the cants are fed sideways into tailbar unit 40 in the direction of arrow 37, this unit directs the cants to linebar unit 35 which, in turn, directs the cants to saw 31. This saw is moved transversely of the path to cut boards of selected widths. As the saw is movable, splitter 45 has to move with it and, therefore, is connected thereto for such movement.

FIGS. 5 to 8 show linebar unit 15 in greater detail. This unit is basically of conventional construction, and includes a base 50 carrying a plurality of parallel transverse rolls 51, each roll having an axial shaft 52 journalled in bearings 53 mounted on the base with sprockets 54 mounted thereon. There are three of these rolls shown in FIG. 5, and the sprockets 54 of these rolls are interconnected by chains 56. A pair of knurled rolls 60 are also carried by base 50. A hydraulic or electric drive motor or motors 62 are attached to one or more roll shafts 61. Chains 64 connect together all the rolls 60 and 51 via sprockets 54 so that all the rolls are driven at the same speed.

Figure 6:
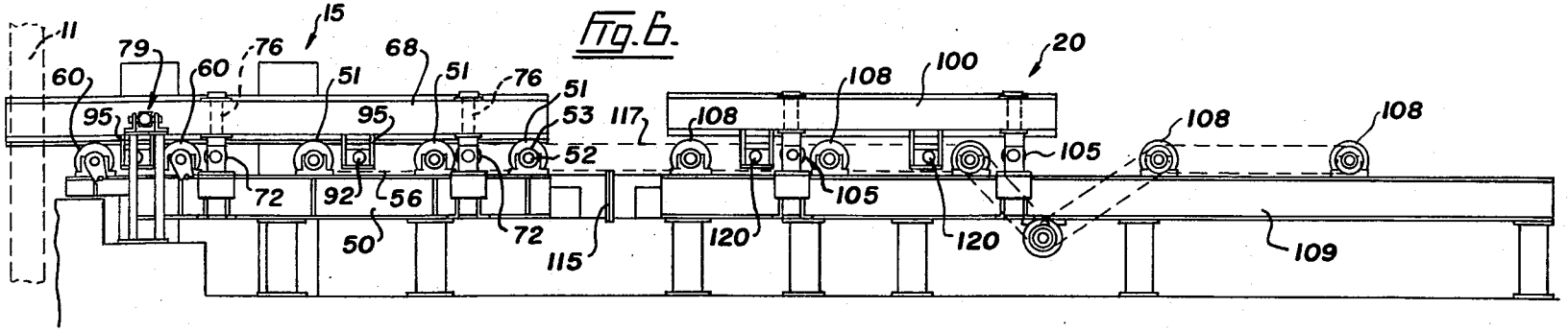
FIG. 6 is an enlarged side elevation of the linebar-tailbar combination of FIG. 5.

A linebar 68 is mounted in unit 15 extending parallel to the lumber path and mounted for movement transversely of said path. In this example, a pair of parallel guide shafts 70 are mounted on base 50 between and below the upper surfaces of the rolls thereof. A sleeve 72 is slidably mounted on each shaft 70 and includes internal ball bushings 73 around the shaft. Each of these sleeves is connected to and supports linebar 68 by a vertical pin 76. Thus, linebar 68 is mounted on shafts 70 for movement back and forth across the path formed by rollers 51 and 62, said linebar being positioned just above the upper surfaces of these rolls, as shown in FIGS. 6 and 7.

A lug 78 is connected to and projects outwardly of linebar 68, to which a setworks is connected, said setworks being diagrammatically illustrated at 79 in FIG. 1. As setworks are well known in the art, it is not necessary to describe the setworks herein. It is sufficient to say that the setworks are operated to select the width of the boards being cut. Linebar 68 has a vertical surface 80 extending parallel to the lumber path, and the cants are moved along this surface of rolls 51 and 60 to and past saw 11.

In this example, a plurality of press rolls 84 are mounted on the opposite side of the lumber path from linebar 68 and are opposed to this bar. Each press roll is mounted on an end of an arm 85, the opposite end of which is swingable mounted on a shaft 86 carried by base 50. Each press roll arm 85 is biased inwardly of the apparatus by an air cylinder unit 88. In addition, each press roll 84 is driven by a suitable power unit, such as a hydraulic motor 89 mounted on arm 85. These press rolls are located at the end of linebar unit 15 adjacent to the resaw and they firmly press the cant against the linebar surface 80 as it is being cut by the saw. The press rolls and the knurled rolls 60 form the main drive means for moving the cant through the saw.

The hydraulic system referred to above includes two hydraulic piston-cylinder units 90, one for each end of linebar 68. Each unit 90 includes a cylinder 92 with a piston rod 93 extending outwardly therefrom. The cylinder units 90 are parallel to each other and to supporting shafts 70. One end of each cylinder unit is connected to linebar 68 and the opposite end of each unit is fixably connected to a part of base 50. In this example, each cylinder 92 is connected by a bracket 95 to the linebar 68, while the outer end of its piston rod 93 is connected at 96 to part of base 60 across from the linebar. With this arrangement, when the linebar is moved back and forth across the lumber path, the two cylinders 92 move with it back and forth along piston rods 93.

Figure 5:
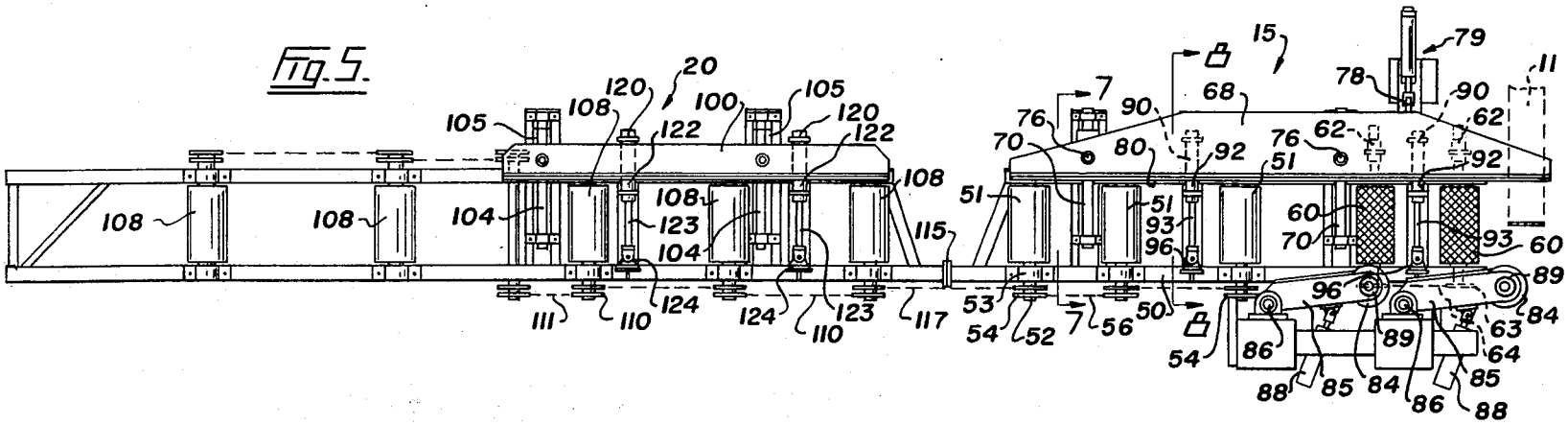
FIG. 5 is an enlarged plan view of the linebar-tailbar combination of FIG. 1.

FIGS. 5 and 8 also show the tailbar unit 20 in detail. This tailbar unit is substantially the same as the linebar unit. The tailbar unit includes a tailbar 100 mounted for movement transversely of the lumber path on parallel support shafts 104 upon which sleeves 105 ride, said sleeves being connected to the tailbar. A plurality of parallel rolls 108 are mounted on the base 109 of the tailbar unit and constitute the bottom of the path of travel in this unit. The rolls 108 are driven in any suitable manner, an in this example, the axial shafts of these rolls have sprockets 110 mounted thereon which are interconnected by chains 111. Base 109 of the tailbar unit is connected to base 50 of the linebar unit at 115. The adjacent rolls 51 and 108 of these units are interconnected by a chain 117 so that rolls 108 rotate at the same speed as rolls of the linebar unit.

A pair of parallel piston-cylinder units 120 are provided in tailbar unit 20. These are the same as the piston-cylinder units of the linebar unit. Each unit 120 includes a cylinder 122 connected to tailbar 100 to move therewith, and an outwardly extending piston rod 123, the opposite end of which is connected at 124 to base 109 on the opposite side thereof from the tailbar. The cants to be cut are directed into unit 20 against tailbar 100 and are moved by rolls 108 into linebar unit 15.

Figure 10:
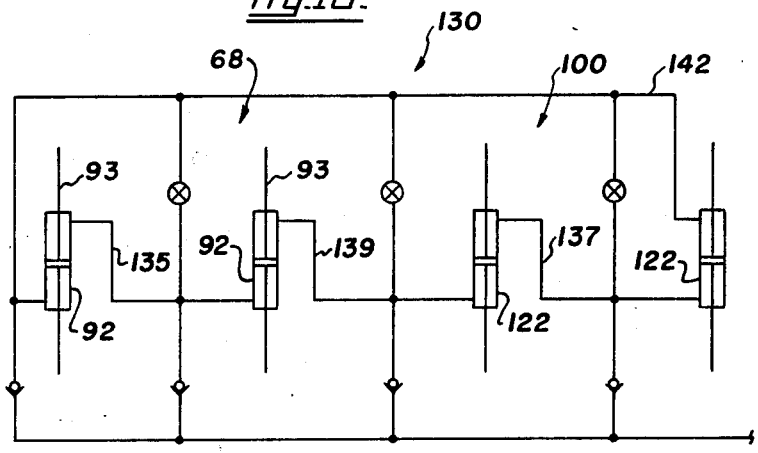
FIG. 10 is a diagrammatic layout of the hydraulic system for the linebar and tailbar, and FIG. 11 diagrammatically illustrates the hydraulic system for the splitter.

FIG. 10 diagrammatically shows the hydraulic system 130 for interconnecting linebar unit 15 and the tailbar unit 20. Referring to the cylinder units from left to right of this Figure, one end of the first or left cylinder 92 is connected to the opposite end of the other cylinder 92 by a pipe 135, and one end of the left cylinder 122 is connected to the opposite end of the other cylinder 122 by pipe 137. Similarly, one end of the right cylinder 92 is connected to the opposite end of the left cylinder 122 by a pipe 139. A return pipe 142 connects one end of the right cylinder 122 to the opposite end of the left cylinder 92. Pipes 139 and 142 constitute the only connections between linebar 68 and tailbar 100.

During operation, when tailbar 68 is moved by the setworks connected thereto, hydraulic fluid flows from one end of one cylinder 92 through pipe 135 to the opposite end of the other cylinder 92 so that the pistons of these cylinders will move in unison exactly the same distance. As the outer ends of the two piston rods 93 are fixed against movement, the ends of the linebar must move in unison and exactly the same distance. When the linebar is not moving, the hydraulic system provides a hydraulic lock between the ends of the bar.

When linebar 68 is moved, hydraulic fluid flows from an end of one of the cylinders 92 through pipe 139 to the opposite end of one of the cylinders 122. At the same time, hydraulic fluid flows from the opposite end of the latter cylinder through pipe 137 to the opposite end of the other cylinder 122. Also, hydraulic fluid flows from the right cylinder 122 through pipe 142 to the left cylinder 92. Thus, the tailbar moves in unison with and exactly the same distance as the linebar, and the ends of the tailbar move exactly the same distance relative to each other. The hydraulic system also provides a lock between the interconnected cylinders 122 and between the interconnected cylinders 92 and 122 so that there is a hydraulic lock between the linebar and the tailbar.

Splitter unit 25 in FIGS. 1 and 2 is a conventional unit. It is positioned downstream of saw 11 and has a plurality of parallel transverse rolls 170 rotatably mounted on an elongated base 171. The upper surfaces of these rolls constitute the bottom of the portion of the lumber path extending away from the saw. In this example, each roll has an inner smooth surface 175 and an outer spirally grooved surface 176. The wood cut by the saw travel over the smooth ends 175 of rolls 170 along a guide surface 177 and are discharged from the outer end of the splitter unit. The remaining cant on the other side of the splitter travels over the spiral portions 176 of the rolls and is directed laterally out of the unit.

A gate 180 mounted on a vertical pin 181 at the outer end of the splitter unit and is selectively swung back and forth by a hydraulic cylinder unit 182. The inner end of gate 180 is swung inwardly and outwardly relative to the splitter so as to permit cut boards of different widths to clear the gate while directing the cut-off pieces laterally out of the splitter.

In the form of the invention illustrated in FIGS. 3 and 4, saw 31 is supported by a base 190 riding on rails 191. The saw is selectively moved transversely of the lumber path by a setworks diagrammatically illustrated at 194.

The splitter 45 of apparatus 10a is provided with rollers 198 that ride on rails 199 extending transversely of but below the path of travel of the lumber. The end of splitter 45 adjacent the saw is connected thereto by an arm 202 so that the splitter is moved by the base 190 as it is shifted by the setworks. The only difference between splitter 45 and splitter 25 is that the former is shifted back and forth across the lumber path by the setworks 194, while the latter is stationary.

Figure 11:
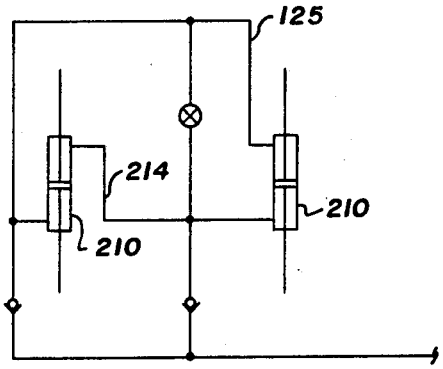

Splitter 45 has a hydraulic system similar to that of the linebar unit. A pair of piston-cylinder units 210 are each connected at one end to the base of the splitter and at its opposite end to a fixed post 212 (see FIG. 9). As shown in FIG. 11, one end of left cylinder unit is connected by a pipe 214 to the opposite end of the right cylinder unit, while the other end of the latter unit is connected by pipe 215 to the opposite end of the left cylinder unit.

Apparatus 10a functions in the same manner as apparatus 10, excepting that the linebar of unit 35 and the tailbar of unit 40 are not movable transversely of the lumber path, while saw 31 and splitter 45 are moved together by the setworks. Lumber is directed into tailbar unit 40 against the tailbar thereof, is moved by this unit into the linebar unit 35 while moving along the linebar of the latter unit. The saw 31 is adjusted by the setworks to determine the width of the wood to be cut, and as the lumber moves past the saw, the dimensioned piece and the other piece move into and along splitter 45. The other piece is directed laterally out of the splitter while the dimensioned piece is discharged from the end of the splitter.

The splitter moves with the saw so as to be in the proper position to receive the cut lumber, and when it moves, the transfer of hydraulic fluid from each of the cylinder units 210 to the opposite end of the other of said units ensures the ends of the splitter moving in unison exactly the same distance.

I claim:

1. Apparatus for longitudinally sawing lengths of wood, comprising supporting means for supporting lengths of wood in a path of travel in which a saw is located, means for moving the wood lengths along the path to be cut longitudinally by the saw, relatively long guide means extending along and parallel with the path and mounted for movement transversely of said path and being selectively movable back and forth across the path by setworks connected thereto, a closed hydraulic system comprising a plurality of piston-cylinder units with a unit near each of opposite ends of the guide means, one end of each cylinder unit being fixed against movement and the opposite end of said each cylinder unit being connected to the adjacent end of the guide means, and pipe means so interconnecting said cylinder units that when the guide means is moved, hydraulic fluid is transfered from an end of one of said units to an opposite end of another of said units to ensure the ends of the guide means moving in unison exactly the same distance.

2. Apparatus as claimed in claim 1 in which said guide means comprises a linebar positioned to guide wood lengths to the saw.

3. Apparatus as claimed in claim 1 in which said saw is movable transversely of said path by the setworks, and the guide means comprises a splitter positioned to receive wood lengths cut by the saw, said splitter being connected to the saw to move therewith.

4. Apparatus as claimed in claim 1 in which said guide means comprises a linebar and a tailbar aligned therewith, said linebar being positioned to guide wood lengths to the saw, said piston-cylinder units including units near and connected to each end of the linebar and of the tailbar, and said pipe means interconnecting said cylinder units to cause the linebar and tailbar to move in unison exactly the same distance when one of them is moved.

5. Apparatus for longitudinally sawing lengths of wood, comprising supporting means for supporting lengths of wood in a path of travel in which a saw is located, means for moving the wood lengths along the path to be cut longitudinally by the saw, a linebar extending along the path near and to the saw and mounted for movement transversely of said path, a tailbar extending along the path and aligned with the linebar at the end thereof remote from the saw and mounted for movement transversely of the path, said linebar being selectively movable transversely of the path by setworks connected thereto, a closed hydraulic system comprising a plurality of piston-cylinder units with a unit near each of the opposite ends of both the linebar and the tailbar, one end of each cylinder unit being fixed against movement and the opposite end of said each cylinder unit being connected to the adjacent end of the linebar or the tailbar, and pipe means so interconnecting said cylinder units that when the linebar is moved, hydraulic fluid is transferred from one end of each unit to an opposite end of another unit to ensure the linebar and the tailbar and the respective ends of the linebar and the tailbar moving in unison exactly the same distance.

6. Apparatus as claimed in claim 5 including a plurality of parallel guide shafts extending transversely of said path below the linebar and the tailbar and bearing sleeves connected to the linebar and the tailbar and riding on said shafts.

7. Apparatus for longitudinally sawing lengths of wood, comprising supporting means for supporting lengths of wood in a path of travel in which a saw is located, said saw being mounted for movement back and forth transversely of the path selectively by setworks connected thereto, guide means along the path for guiding the wood lengths to the saw, means for moving the wood lengths along the path to be cut longitudinally by the saw, guide means comprising a relatively long splitter extending away from the saw in said path to receive wood lengths cut by the saw, said splitter being mounted to move transversely of the path, means to connect an end of the splitter to the saw to cause the splitter to move therewith, a closed hydraulic system comprising a plurality of piston-cylinder units with a unit near each of opposite ends of the splitter, one end of each cylinder unit being fixed against movement and the opposite end of said each cylinder unit being connected to the adjacent end of the splitter, and pipe means so interconnecting said cylinder units that when the splitter is moved, hydraulic fluid is transferred from an end of one of said units to an opposite end of another of said units to ensure both ends of the splitter moving in unison exactly the same distance.

* * * * *